US009093024B2

(12) United States Patent
Handa et al.

(10) Patent No.: US 9,093,024 B2
(45) Date of Patent: Jul. 28, 2015

(54) IMAGE DISPLAY APPARATUS INCLUDING A NON-EMISSION PERIOD LOWERING THE GATE AND SOURCE VOLTAGE OF THE DRIVE TRANSISTOR

(75) Inventors: Tomoaki Handa, Tokyo (JP); Yuuki Seo, Kanagawa (JP); Hiroshi Sagawa, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 293 days.

(21) Appl. No.: 13/597,491

(22) Filed: Aug. 29, 2012

(65) Prior Publication Data

US 2012/0320029 A1 Dec. 20, 2012

Related U.S. Application Data

(63) Continuation of application No. 12/453,162, filed on Apr. 30, 2009, now Pat. No. 8,269,697.

(30) Foreign Application Priority Data

Jun. 2, 2008 (JP) ..... 2008-144061

(51) Int. Cl.
*G09G 3/30* (2006.01)
*G09G 3/32* (2006.01)

(52) U.S. Cl.
CPC ..... *G09G 3/3233* (2013.01); *G09G 3/3266* (2013.01); *G09G 3/3291* (2013.01); *G09G 2300/0819* (2013.01); *G09G 2300/0842* (2013.01); *G09G 2300/0866* (2013.01); *G09G 2310/0256* (2013.01)

(58) Field of Classification Search
CPC ..... G09G 3/30; G09G 3/32; G09G 3/3208; G09G 3/3216; G09G 3/3225; G09G 3/3233; G09G 3/3258
USPC ..... 345/76–83; 315/169.3
See application file for complete search history.

(56) References Cited

U.S. PATENT DOCUMENTS 6,950,081 B2 * 9/2005 Akimoto et al. ..... 345/55
7,889,159 B2 2/2011 Nathan et al.
7,893,895 B2 2/2011 Uchino et al.

(Continued)

FOREIGN PATENT DOCUMENTS

JP 2006-338042 12/2006
JP 2007-005646 A 1/2007

(Continued)

OTHER PUBLICATIONS

Japanese Office Action issued Apr. 13, 2010 for corresponding Japanese Application No. 2008-144061.

(Continued)

*Primary Examiner* — Alexander Eisen
*Assistant Examiner* — Nelson Lam
(74) *Attorney, Agent, or Firm* — Fishman Stewart Yamaguchi PLLC

(57) ABSTRACT

An image display device and method of driving an image display device with alternative repeating of an emission period during which the light emitting element is made to emit light and a non-emission period during which light emission of the light emitting element is stopped. The terminal voltage of a storage capacitor is set to the voltage of a signal line, whereby light emission luminance of the light emitting element in a next emission period is set.

8 Claims, 17 Drawing Sheets

(56) References Cited

U.S. PATENT DOCUMENTS

| | | | | |
|---|---|---|---|---|
| 2004/0174349 | A1 | 9/2004 | Libsch et al. | |
| 2005/0041002 | A1 | 2/2005 | Takahara et al. | |
| 2005/0264228 | A1* | 12/2005 | Kim | 315/169.3 |
| 2005/0285829 | A1 | 12/2005 | Akimoto et al. | |
| 2006/0139266 | A1 | 6/2006 | Choi | |
| 2006/0170628 | A1* | 8/2006 | Yamashita et al. | 345/76 |
| 2006/0244695 | A1 | 11/2006 | Komiya | |
| 2007/0109232 | A1* | 5/2007 | Yamamoto et al. | 345/77 |
| 2007/0115224 | A1* | 5/2007 | Yamamoto et al. | 345/76 |
| 2007/0216613 | A1 | 9/2007 | Ogura et al. | |
| 2008/0284679 | A1* | 11/2008 | Ishizuka | 345/55 |
| 2010/0277402 | A1 | 11/2010 | Miyazawa | |
| 2013/0314306 | A1* | 11/2013 | Yamashita et al. | 345/77 |
| 2014/0218419 | A1* | 8/2014 | Hasegawa et al. | 345/691 |

FOREIGN PATENT DOCUMENTS

| | | | |
|---|---|---|---|
| JP | 2007-133284 | | 5/2007 |
| JP | 2007-310311 | | 11/2007 |
| JP | 2008-032866 | A | 2/2008 |
| JP | 2008-051990 | A | 3/2008 |
| JP | 2008-083107 | A | 4/2008 |
| JP | 2008-122632 | A | 5/2008 |

OTHER PUBLICATIONS

Korean Office Action issued May 21, 2015 for corresponding Korean Application No. 10-2009-0046261.

* cited by examiner

RELATED ART

RELATED ART

RELATED ART

RELATED ART

RELATED ART

RELATED ART

IMAGE DISPLAY APPARATUS INCLUDING A NON-EMISSION PERIOD LOWERING THE GATE AND SOURCE VOLTAGE OF THE DRIVE TRANSISTOR

CROSS REFERENCES TO RELATED APPLICATIONS

This is a Continuation Application of U.S. patent application Ser. No. 12/453,162, filed Apr. 30, 2009, which in turn claims priority from Japanese Application No. 2008-144061, filed on Jun. 2, 2008, the entire contents of which are incorporated herein by reference.

BACKGROUND OF THE INVENTION

1. Field of the Invention

The present invention relates to an image display device, and is applicable to an active matrix type image display device using Jun. 2, 2008 (Electro Luminescence) element, for example. The present invention disposes a switch transistor between a driving transistor and a light emitting element, and sets the switch transistor in an off state during non-emission periods, whereby variation in threshold voltage of the driving transistor is corrected while destruction of the light emitting element due to a reverse bias is effectively avoided.

2. Description of the Related Art

In related art, an active matrix type image display device using an organic EL element has a display section formed by arranging pixel circuits each formed by the organic EL element and a driving circuit for driving the organic EL element in the form of a matrix. The image display device of this type has each pixel formed by an organic EL element provided in the pixel circuit, and drives each pixel circuit by a signal line driving circuit and a scanning line driving circuit arranged on the periphery of the display section to display a desired image.

In relation to the image display device using the organic EL element, Japanese Patent Laid-Open No. 2007-310311 (hereinafter referred to as Patent Document 1) discloses a method of forming a pixel circuit using two transistors. Thus, according to the method disclosed in Patent Document 1, a constitution can be simplified. Patent Document 1 also discloses a constitution for correcting a variation in threshold voltage and a variation in mobility of a driving transistor driving an organic EL element. Thus, according to the constitution disclosed in Patent Document 1, degradation in image quality due to a variation in threshold voltage and a variation in mobility of the driving transistor can be prevented.

FIG. 10 is a block diagram showing the image display device disclosed in Patent Document 1. The image display device 1 has a display section 2 created on an insulating substrate of glass or the like. The image display device 1 has a signal line driving circuit 3 and a scanning line driving circuit 4 created on the periphery of the display section 2.

The display section 2 is formed by arranging pixel circuits 5 in the form of a matrix, and pixels (PIX) 6 are formed by organic EL elements provided in the pixel circuits 5. Incidentally, in an image display device for color images, one pixel is formed by a plurality of sub-pixels of red, green, and blue. Thus, in the case of the image display device for color images, the display section 2 is formed by sequentially arranging pixel circuits 5 for red, green, and blue forming sub-pixels of red, green, and blue, respectively.

The signal line driving circuit 3 outputs driving signals Ssig for signal lines to signal lines DTL provided in the display section 2. More specifically, a data scan circuit 3A in the signal line driving circuit 3 distributes image data D1 input in the order of raster scanning to the signal lines DTL by sequentially latching the image data D1, and thereafter subjects each piece of the distributed image data D1 to a digital-to-analog conversion process. The signal line driving circuit 3 processes a result of the digital-to-analog conversion, and generates the driving signals Ssig. The image display device 1 thereby sets a gradation of each pixel circuit 5 on a so-called line-sequential basis, for example.

The scanning line driving circuit 4 outputs a writing signal WS and a driving signal DS to scanning lines WSL for writing signals and scanning lines DSL for power supply, respectively, the scanning lines WSL and the scanning lines DSL being provided in the display section 2. The writing signal WS is a signal for performing on-off control on a writing transistor provided in each pixel circuit 5. The driving signal DS is a signal for controlling the drain voltage of a driving transistor provided in each pixel circuit 5. A write scan circuit (WSCN) 4A and a drive scan circuit (DSCN) 4B in the scanning line driving circuit 4 each process a predetermined sampling pulse SP with a clock CK to generate the writing signal WS and the driving signal DS.

FIG. 11 is a connection diagram showing details of a configuration of a pixel circuit 5. In the pixel circuit 5, the cathode of an organic EL element 8 is set at a predetermined negative side voltage. In the example of FIG. 11, the negative side voltage is set at the voltage of a ground line. In the pixel circuit 5, the anode of the organic EL element 8 is connected to the source of a driving transistor Tr2. Incidentally, the driving transistor Tr2 is an N-channel type transistor formed by a TFT, for example. In the pixel circuit 5, the drain of the driving transistor Tr2 is connected to a scanning line DSL for power supply, and a driving signal DS for power supply is supplied from the scanning line driving circuit 4 to the scanning line DSL. Thus, the pixel circuit 5 current-drives the organic EL element 8 using the driving transistor Tr2 of a source follower circuit configuration.

The pixel circuit 5 has a storage capacitor Cs between the gate and the source of the driving transistor Tr2. The gate side terminal voltage of the storage capacitor Cs is set at the voltage of a driving signal Ssig by a writing signal WS. As a result, the pixel circuit 5 current-drives the organic EL element 8 by the driving transistor Tr2 according to a gate-to-source voltage Vgs corresponding to the driving signal Ssig. Incidentally, in FIG. 11, a capacitance Cel is a stray capacitance of the organic EL element 8. Suppose in the following that the capacitance Cel is sufficiently larger than the capacitance of the storage capacitor Cs, and that the parasitic capacitance of the gate node of the driving transistor Tr2 is sufficiently smaller than the capacitance of the storage capacitor Cs.

In the pixel circuit 5, the gate of the driving transistor Tr2 is connected to a signal line DTL via a writing transistor Tr1, which performs on-off operation according to the writing signal WS. Incidentally, in this case, the writing transistor Tr1 is an N-channel type transistor formed by a TFT, for example. In this case, the signal line driving circuit 3 outputs the driving signal Ssig by selecting a gradation setting voltage Vsig and a voltage Vofs for threshold voltage correction in predetermined timing. In this case, the fixed voltage Vofs for threshold voltage correction is a fixed voltage used to correct a variation in threshold voltage of the driving transistor Tr2. The gradation setting voltage Vsig is a voltage indicating the light emission luminance of the organic EL element 8, and is a voltage obtained by adding the fixed voltage Vofs for threshold voltage correction to a gradation voltage Vin. The gradation voltage Vin is a voltage corresponding to the light emission luminance of the organic EL element 8. The gradation voltage Vin is generated for each signal line DTL by subjecting each piece of image data D1 distributed to each signal line DTL to a digital-to-analog conversion process.

In the pixel circuit 5, as shown in FIGS. 12A to 12E, the writing transistor Tr1 is set in an off state by the writing signal WS during an emission period during which the organic EL element 8 is made to emit light (FIG. 12A). In the pixel circuit 5, during the emission period, a power supply voltage Vcc is supplied to the driving transistor Tr2 by the driving signal DS for power supply (FIG. 12B). As shown in FIG. 13, the pixel circuit 5 thereby makes the organic EL element 8 emit light by a driving current Ids corresponding to the gate-to-source voltage Vgs (FIGS. 12D and 12E) of the driving transistor Tr2, which voltage is a voltage across the storage capacitor Cs, during the emission period.

In the pixel circuit 5, the driving signal DS for power supply is lowered to a predetermined fixed voltage Vss at time t0 at which the emission period ends (FIG. 12B). The fixed voltage Vss is a voltage low enough to make the drain of the driving transistor Tr2 function as a source, and is a voltage lower than the cathode voltage of the organic EL element 8.

Thereby, in the pixel circuit 5, as shown in FIG. 14, an accumulated charge of the terminal on the organic EL element 8 side of the storage capacitor Cs flows out to the scanning line via the driving transistor Tr2. As a result, in the pixel circuit 5, the source voltage Vs of the driving transistor Tr2 is lowered to the voltage Vss (FIG. 12E), and the organic EL element 8 stops emitting light. In addition, in the pixel circuit 5, the gate voltage Vg of the driving transistor Tr2 is lowered in such a manner as to be interlocked with the lowering of the source voltage Vs (FIG. 12D).

Incidentally, to be more exact, due to the lowering of the drain voltage to the fixed voltage Vss, the gate voltage Vg of the driving transistor Tr2 is maintained at a voltage lowered from the fixed voltage Vss by the threshold voltage of the drain-to-gate voltage of the driving transistor Tr2. The source voltage Vs of the driving transistor Tr2 is maintained at a voltage lowered from the gate voltage Vg by a gate-to-source voltage in an immediately preceding emission period.

In the pixel circuit 5, at a predetermined next time t1, the writing transistor Tr1 is changed to an on state by the writing signal WS (FIG. 12A), and the gate voltage Vg of the driving transistor Tr2 is set at the fixed voltage Vofs for threshold voltage correction which voltage Vofs is set in the signal line DTL (FIGS. 12C and 12D). Thereby, in the pixel circuit 5, as shown in FIG. 15, the gate-to-source voltage Vgs of the driving transistor Tr2 is set at substantially a voltage Vofs-Vss. In the pixel circuit 5, due to the settings of the voltages Vofs and Vss, the voltage Vofs-Vss is set to a voltage larger than the threshold voltage Vth of the driving transistor Tr2.

Thereafter, in the pixel circuit 5, the drain voltage of the driving transistor Tr2 is raised to a power supply voltage Vcc by the driving signal DS at time t2 (FIG. 12B). Thereby, in the pixel circuit 5, as shown in FIG. 16, a charging current Ids flows in from the power supply Vcc to the terminal on the organic EL element 8 side of the storage capacitor Cs via the driving transistor Tr2. As a result, in the pixel circuit 5, the voltage Vs of the terminal on the organic EL element 8 side of the storage capacitor Cs rises gradually. Incidentally, in this case, in the pixel circuit 5, the current Ids flowing into the organic EL element 8 via the driving transistor Tr2 is used only to charge the capacitance Cel of the organic EL element 8 and the storage capacitor Cs. As a result, only the source voltage Vs of the driving transistor Tr2 rises without the organic EL element 8 emitting light.

In the pixel circuit 5, when the voltage across the storage capacitor Cs becomes the threshold voltage Vth of the driving transistor Tr2, the charging current Ids stops flowing in via the driving transistor Tr2. Thus, in this case, the source voltage Vs of the driving transistor Tr2 stops rising when the voltage across the storage capacitor Cs becomes the threshold voltage Vth of the driving transistor Tr2. The pixel circuit 5 thereby discharges the voltage across the storage capacitor Cs via the driving transistor Tr2, and sets the voltage across the storage capacitor Cs to the threshold voltage Vth of the driving transistor Tr2.

In the pixel circuit 5, at time t3 after the passage of a sufficient time to set the voltage across the storage capacitor Cs to the threshold voltage Vth of the driving transistor Tr2, as shown in FIG. 17, the writing transistor Tr1 is changed to an off state by the writing signal WS (FIG. 12A). Next, as shown in FIG. 18, the voltage of the signal line DTL is set to the gradation setting voltage Vsig (=Vin+Vofs).

In the pixel circuit 5, the writing transistor Tr1 is set in an on state at next time t4 (FIG. 12A). Thereby, in the pixel circuit 5, as shown in FIG. 19, the gate voltage Vg of the driving transistor Tr2 is set at the gradation setting voltage Vsig, and the gate-to-source voltage Vgs of the driving transistor Tr2 is set at a voltage obtained by adding the threshold voltage Vth of the driving transistor Tr2 to a gradation voltage Vin. Thereby, the pixel circuit 5 can drive the organic EL element 8 while effectively avoiding a variation in threshold voltage Vth of the driving transistor Tr2, and thus prevent degradation in image quality due to a variation in light emission luminance of the organic EL element 8.

In the pixel circuit 5, at the time of setting the gate voltage Vg of the driving transistor Tr2 to the gradation setting voltage Vsig, the gate of the driving transistor Tr2 is connected to the signal line DTL for a certain period with the drain voltage of the driving transistor Tr2 maintained at the power supply voltage Vcc. Thereby the pixel circuit 5 also corrects a variation in mobility μ of the driving transistor Tr2.

That is, when the gate of the driving transistor Tr2 is connected to the signal line DTL by setting the writing transistor Tr1 in an on state with the voltage across the storage capacitor Cs set to the threshold voltage Vth of the driving transistor Tr2, the gate voltage Vg of the driving transistor Tr2 gradually rises from the fixed voltage Vofs and is set to the gradation setting voltage Vsig.

In the pixel circuit 5, a writing time constant necessary for the rising of the gate voltage Vg of the driving transistor Tr2 is set shorter than a time constant necessary for the rising of the source voltage Vs of the driving transistor Tr2.

In this case, when the writing transistor Tr1 performs an on operation, the gate voltage Vg of the driving transistor Tr2 quickly rises to the gradation setting voltage Vsig (Vofs+Vin). At the time of the rising of the gate voltage Vg, when the capacitance Cel of the organic EL element 8 is sufficiently larger than the capacitance of the storage capacitor Cs, the source voltage Vs of the driving transistor Tr2 does not vary.

However, when the gate-to-source voltage Vgs of the driving transistor Tr2 becomes larger than the threshold voltage Vth, the current Ids flows in from the power supply Vcc via the driving transistor Tr2, and the source voltage Vs of the driving transistor Tr2 rises gradually. As a result, in the pixel circuit 5, the voltage across the storage capacitor Cs is discharged by the driving transistor Tr2, and the rising speed of the gate-to-source voltage Vgs is lowered.

The discharging speed of the voltage across the storage capacitor Cs changes according to the capability of the driving transistor Tr2. More specifically, the higher the mobility μ of the driving transistor Tr2, the faster the discharging speed.

As a result, in the pixel circuit 5, the higher the mobility μ of the driving transistor Tr2, the lower the voltage across the storage capacitor Cs, whereby a variation in light emission luminance due to a variation in mobility is corrected. Incidentally, an amount of decrease in the voltage across the storage capacitor Cs which decrease is involved in correcting the mobility μ is represented by ΔV in FIGS. 12A to 12E, FIG. 19, and FIG. 20.

In the pixel circuit 5, after the passage of the mobility correcting period, the writing signal WS is lowered at time t5. As a result, the pixel circuit 5 starts an emission period, and makes the organic EL element 8 emit light by the driving current Ids corresponding to the voltage across the storage capacitor Cs, as shown in FIG. 20. Incidentally, in the pixel circuit 5, after the emission period is started, the gate voltage Vg and the source voltage Vs of the driving transistor Tr2 are raised by a so-called bootstrap circuit. Vel in FIG. 20 is a voltage of an amount of the rise.

Thus, the pixel circuit 5 prepares for the process of correcting the threshold voltage of the driving transistor Tr2 in a period from time t0 to time t2 in which period the gate voltage of the driving transistor Tr2 is lowered to the voltage Vss. In a next period from time t2 to time t3, the pixel circuit 5 sets the voltage across the storage capacitor Cs to the threshold voltage Vth of the driving transistor Tr2 to correct the threshold voltage of the driving transistor Tr2. In addition, in a period from time t4 to time t5, the pixel circuit 5 corrects the mobility of the driving transistor Tr2, and samples the gradation setting voltage Vsig.

Japanese Patent Laid-Open No. 2007-133284 (hereinafter referred to as Patent Document 2) proposes a constitution in which the process of correcting a variation in the threshold voltage of the driving transistor Tr2 is divided and performed a plurality of times. According to the constitution disclosed in Patent Document 2, a sufficient time can be assigned to the correction of variation in the threshold voltage even when a time assigned to the setting of a gradation in a pixel circuit is shortened with increase in precision. Thus, even when precision is increased, degradation in image quality due to variation in the threshold voltage can be prevented.

It is therefore considered that when the method disclosed in Patent Document 2 is applied to the method disclosed in Patent Document 1, a display device capable of maintaining high image quality even when precision is increased can be obtained by a simple constitution.

FIGS. 21A, 21B, 21C, 21D, 21E, and 21F are time charts of a pixel circuit considered when the method disclosed in Patent Document 2 is applied to the method disclosed in Patent Document 1 by contrast with FIGS. 12A to 12E.

In this case, gradation setting voltages Vsig for respective pixel circuits 5 connected to the signal line DTL are output to the signal line DTL with the fixed voltage Vofs for threshold voltage correction interposed between the gradation setting voltages Vsig. In the pixel circuit 5, the writing signal WS is raised intermittently so as to correspond to the driving of the signal line DTL, and the voltage across the storage capacitor Cs is discharged via the driving transistor Tr2 in a plurality of periods. Thereby, in the example of FIGS. 21A to 21F, a variation in threshold voltage of the driving transistor Tr2 is corrected in a plurality of separate periods. Incidentally, in FIGS. 21A to 21F, VD denotes a vertical synchronizing signal.

In addition, Japanese Patent Laid-Open No. 2006-338042 (hereinafter referred to as Patent Document 3) discloses a constitution that sets the light emission luminance of an organic EL element by current driving.

SUMMARY OF THE INVENTION

In the constitution of FIG. 11, the light emission of the organic EL element 8 is stopped by lowering the drain voltage of the driving transistor Tr2 to the predetermined voltage Vss. As a result, during the period when the light emission of the organic EL element 8 is stopped, the organic EL element 8 is maintained in a reverse-biased state. When maintained in a reverse-biased state, the organic EL element may be destroyed depending on the magnitude and time of the reverse bias.

Thus, in the constitution of FIG. 11, there is a fear of the organic EL element 8 being destroyed and thereby a dark dot being produced. Incidentally, in the constitution of FIG. 11, the destruction of the organic EL element 8 can be prevented by raising the predetermined voltage Vss and thus reducing the amount of the reverse bias applied to the organic EL element 8. However, when the voltage Vss is raised, it becomes difficult to set the voltage across the storage capacitor Cs to a voltage more than the threshold voltage of the driving transistor Tr2, and resultingly it becomes impossible to correct a variation in the threshold voltage of the driving transistor Tr2.

Embodiments of the present invention have been made in view of the above, and are to propose an image display device that can correct variation in threshold voltage of a driving transistor while effectively avoiding destruction of an organic EL element due to a reverse bias.

According to an embodiment of the present invention, there is provided an image display device wherein a display section is formed by arranging pixel circuits in a form of a matrix, the pixel circuits each include at least a light emitting element, a switch transistor, a driving transistor for current-driving the light emitting element by a driving current corresponding to a gate-to-source voltage of the driving transistor via the switch transistor, a storage capacitor for retaining the gate-to-source voltage, and a writing transistor for setting a terminal voltage of the storage capacitor by a voltage of a signal line, an emission period during which the light emitting element is made to emit light and a non-emission period during which light emission of the light emitting element is stopped are alternately repeated, in the non-emission period, after a voltage across the storage capacitor is set to a voltage more than a threshold voltage of the driving transistor, the voltage across the storage capacitor is set to a voltage corresponding to the threshold voltage of the driving transistor, and the terminal voltage of the storage capacitor is set to the voltage of the signal line, whereby light emission luminance of the light emitting element in the next emission period is set, and the switch transistor is set in an off state during the non-emission period.

With the constitution of the above-described embodiment, when the switch transistor is set in an off state during the non-emission period, the process of setting the voltage across the storage capacitor to a voltage more than the threshold voltage of the driving transistor and the like can be performed while the driving transistor and the light emitting element are disconnected from each other. Thus, the application of a reverse bias to the light emitting element in this process and the like can be prevented.

According to the embodiment of the present invention, it is possible to correct a variation in threshold voltage of a driving transistor while effectively avoiding destruction of an organic EL element due to a reverse bias.

DETAILED DESCRIPTION OF THE PREFERRED EMBODIMENTS

Figure 1:
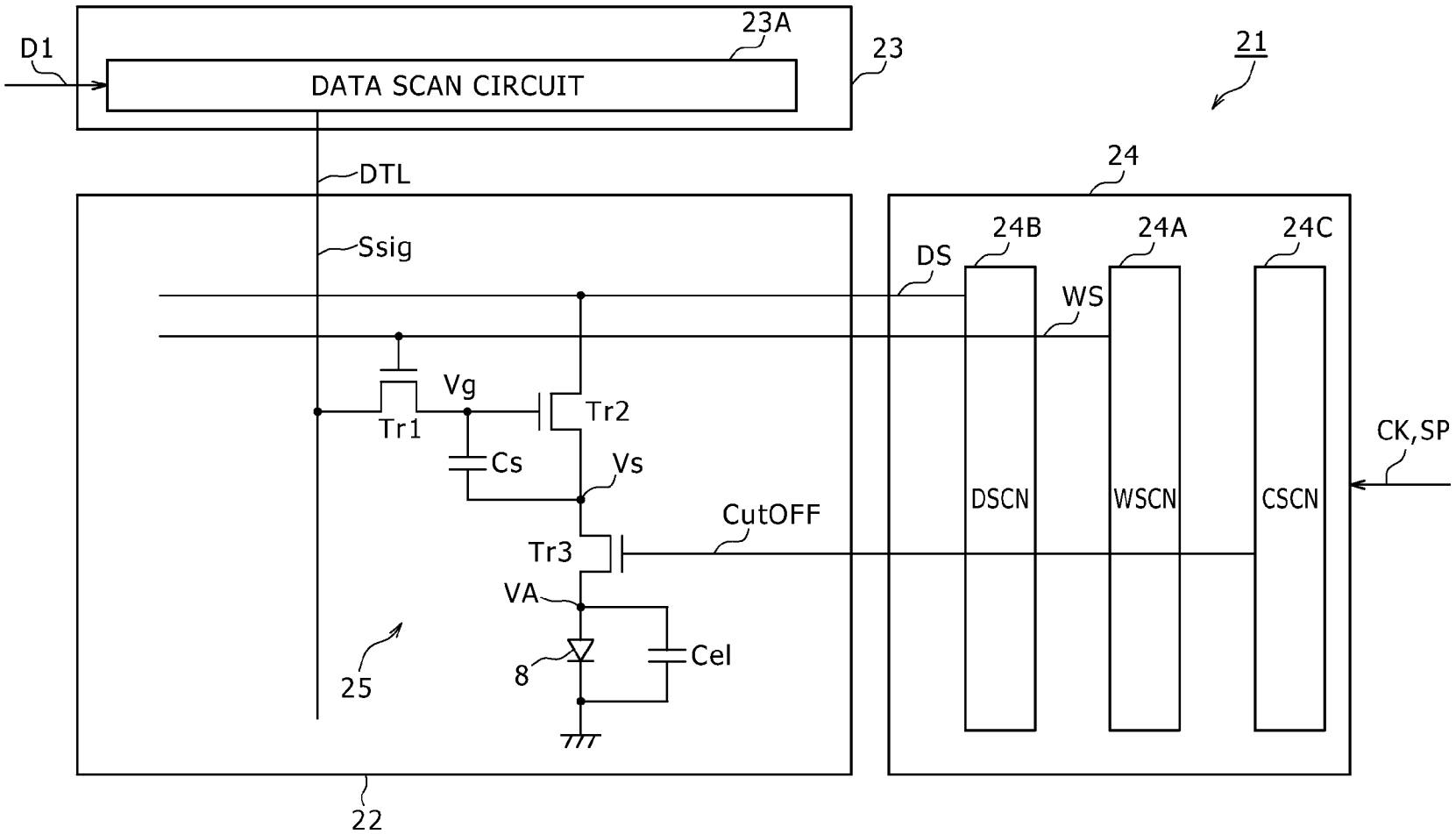
FIG. 1 is a connection diagram showing an image display device according to a first embodiment of the present invention.

Preferred embodiments of the present invention will hereinafter be described in detail referring to the drawings as appropriate.

First Embodiment

(1) Constitution of First Embodiment

Figure 2:
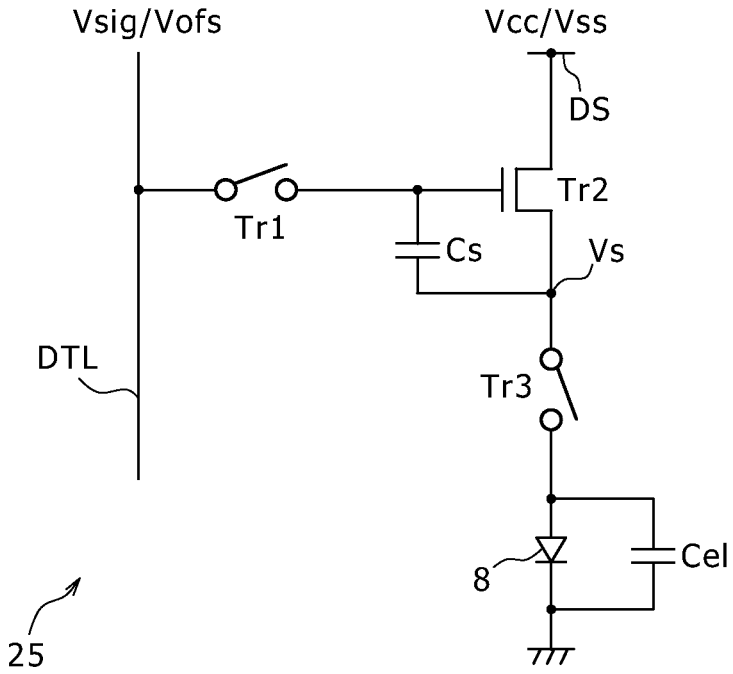
FIG. 2 is a connection diagram showing a pixel circuit in the image display device of FIG. 1 in a simplified manner.
Figure 3:
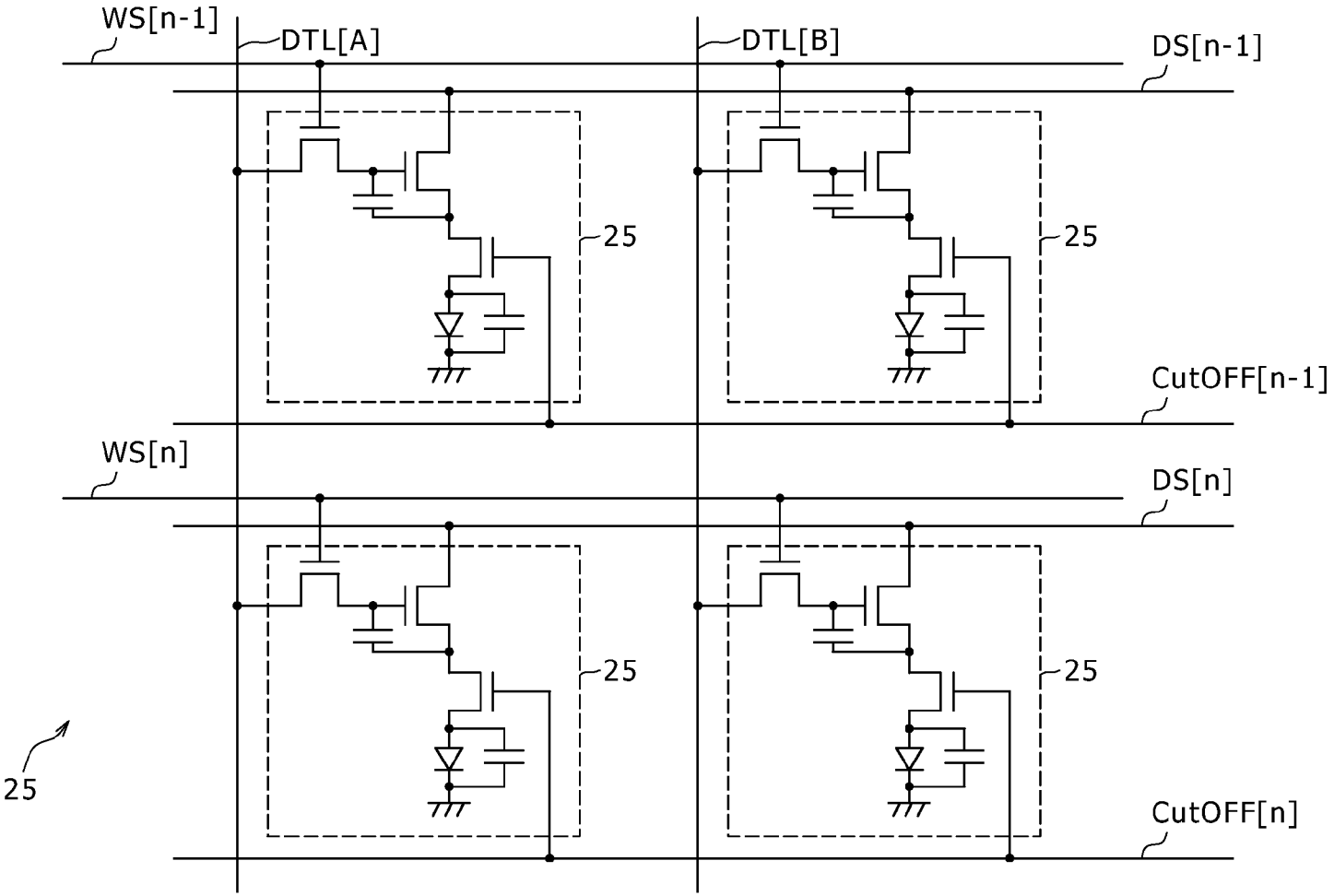
FIG. 3 is a connection diagram showing a configuration of a display section using the pixel circuit of FIG. 2.
Figure 11:
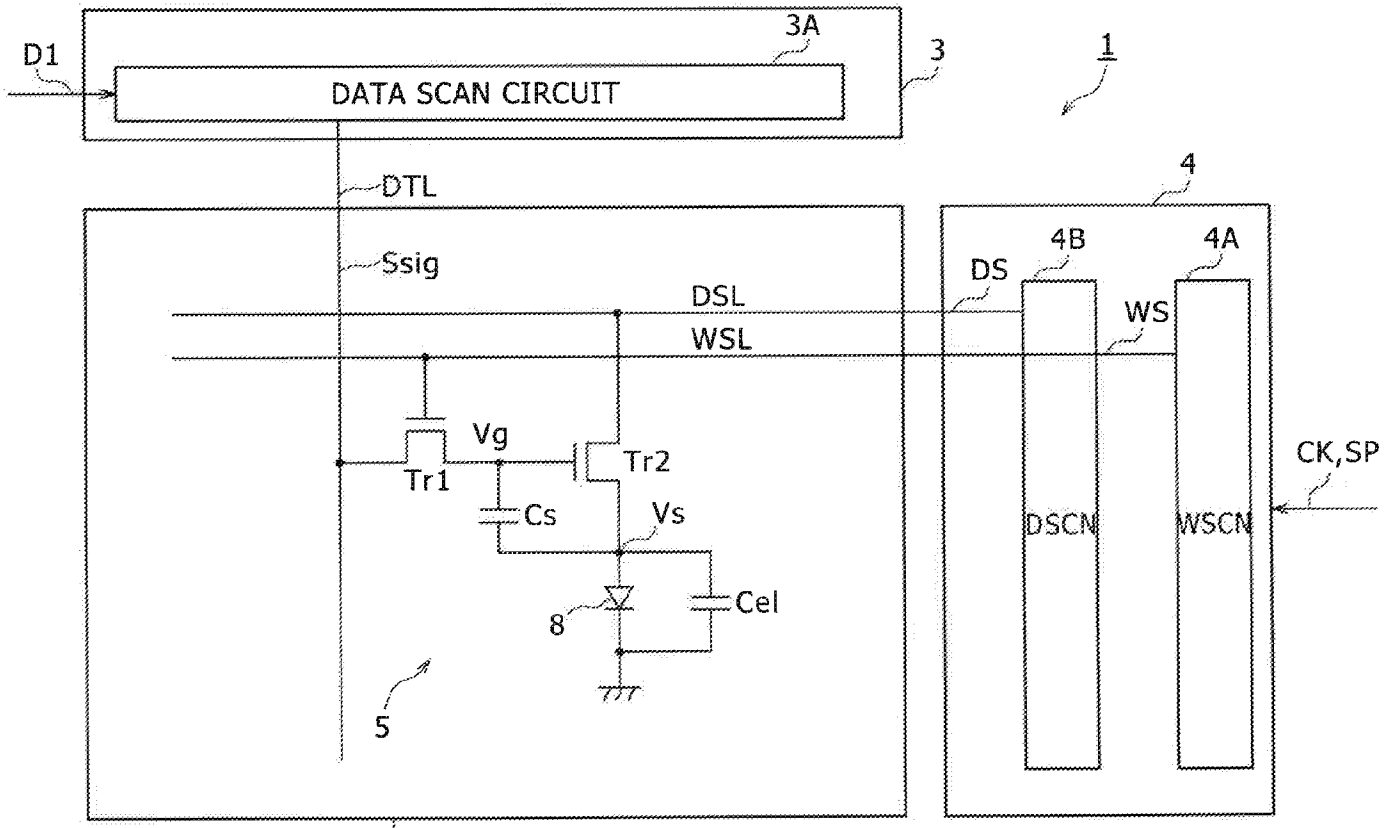
FIG. 11 is a connection diagram showing a pixel circuit in the image display device of FIG. 10.
Figures 12A, 12B, 12C, 12D, 12E:
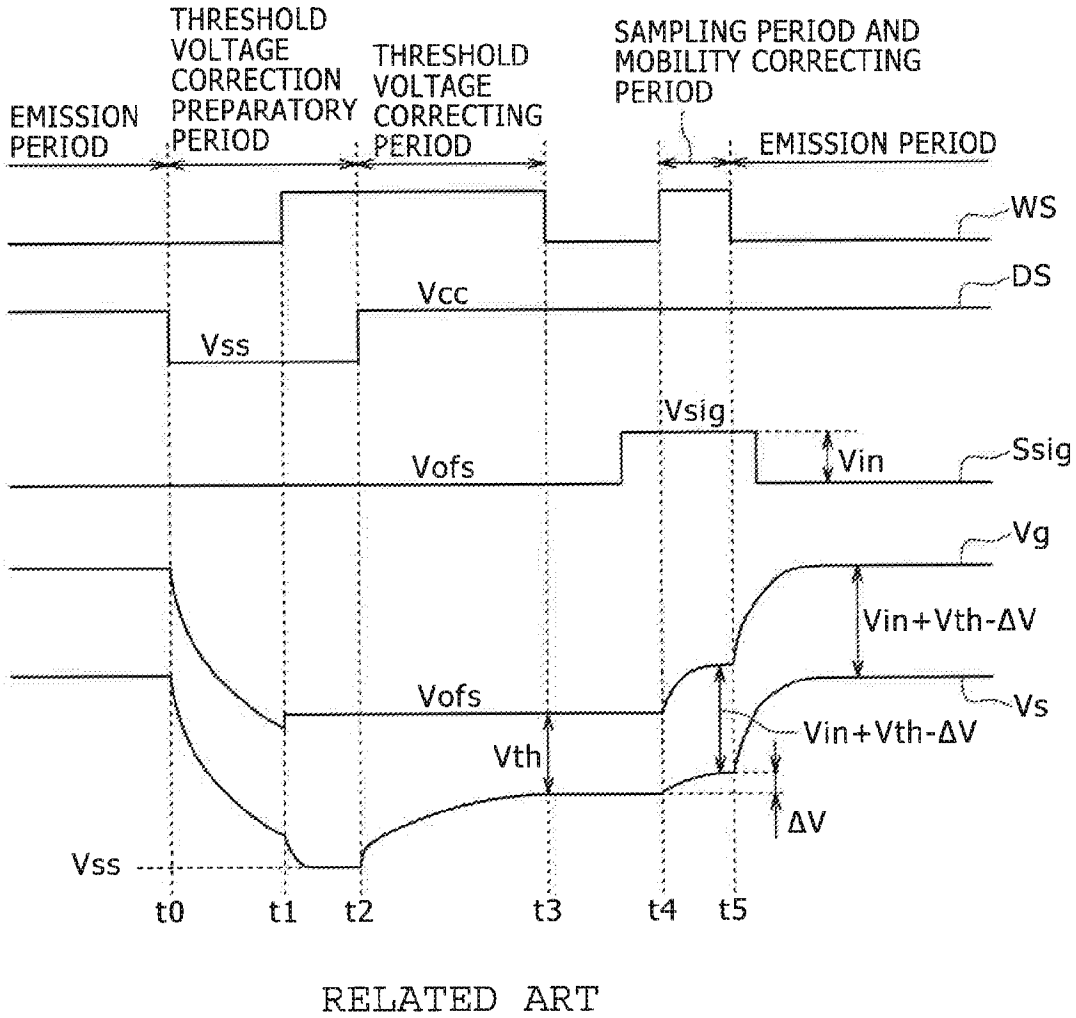
FIG.12E RELATED ART
FIGS. 12A, 12B, 12C, 12D, and 12E are time charts of assistance in explaining operation of the pixel circuit of FIG. 11.
Figure 13:
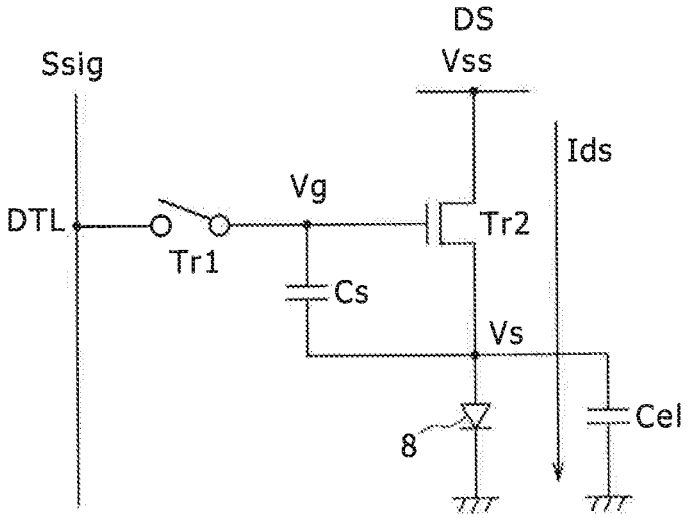
FIG. 13 is a connection diagram of assistance in explaining the time charts of FIGS. 12A to 12E.
Figure 14:
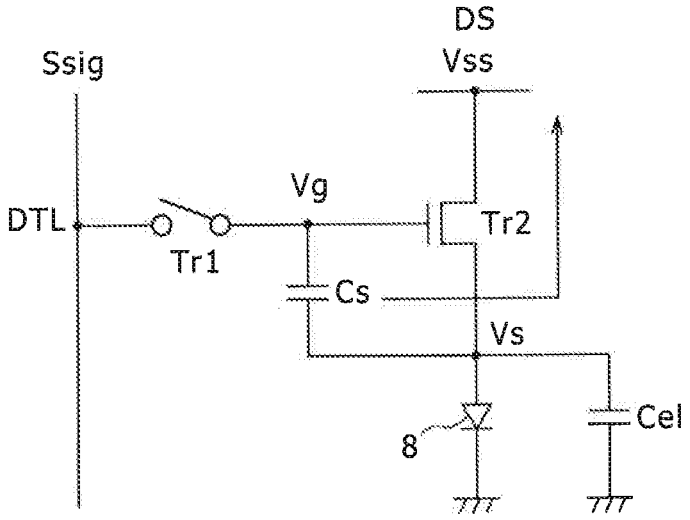
RELATED ART FIG.14
FIG. 14 is a connection diagram of assistance in explaining a continuation of FIG. 13.
Figure 15:
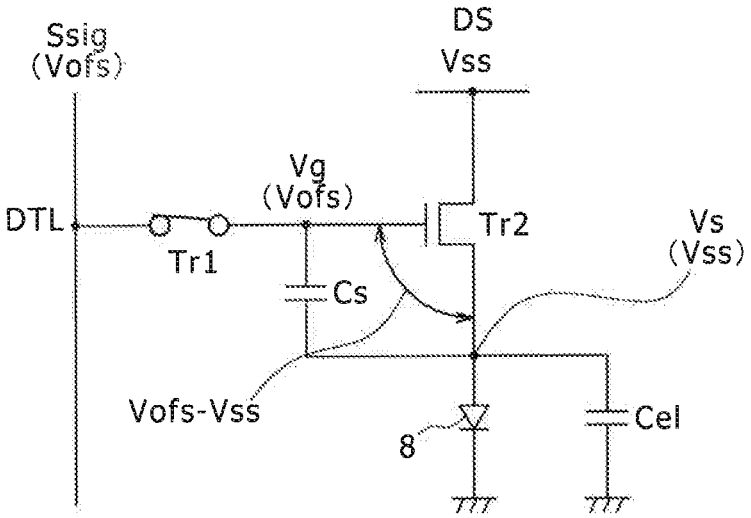
FIG. 15 is a connection diagram of assistance in explaining a continuation of FIG. 14.
Figure 16:
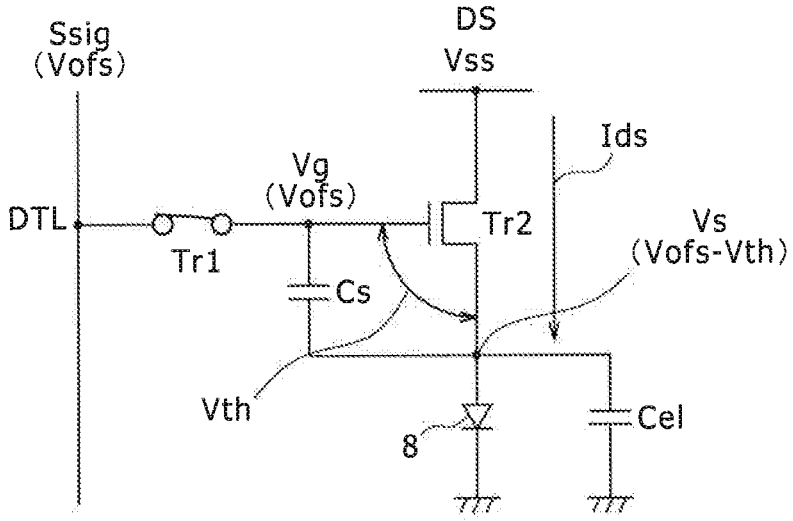
RELATED ART FIG.16
FIG. 16 is a connection diagram of assistance in explaining a continuation of FIG. 15.
Figure 17:
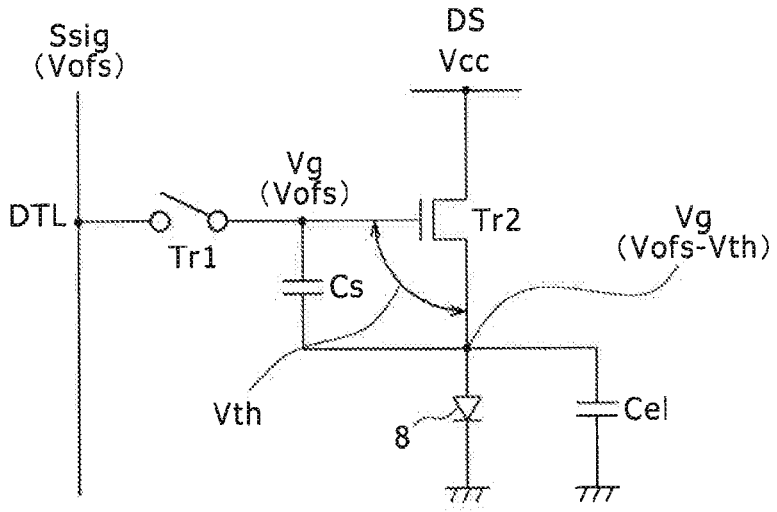
FIG. 17 is a connection diagram of assistance in explaining a continuation of FIG. 16.
Figure 18:
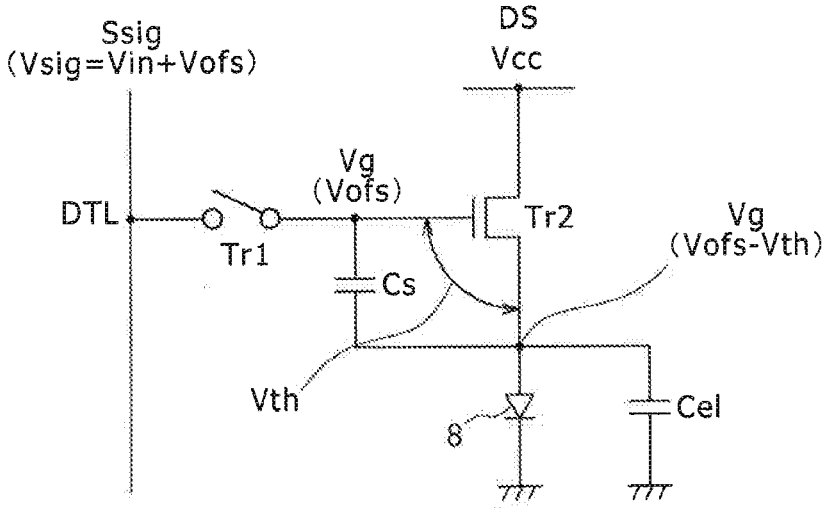
RELATED ART FIG.18
FIG. 18 is a connection diagram of assistance in explaining a continuation of FIG. 17.
Figure 19:
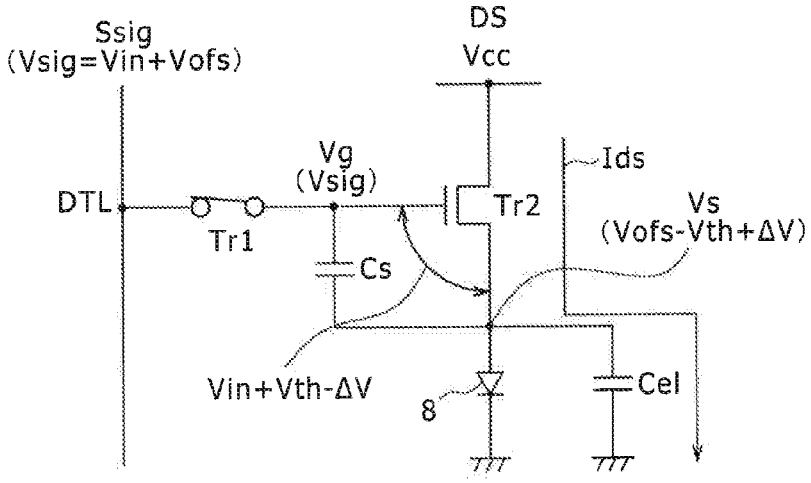
FIG. 19 is a connection diagram of assistance in explaining a continuation of FIG. 18.
Figure 20:
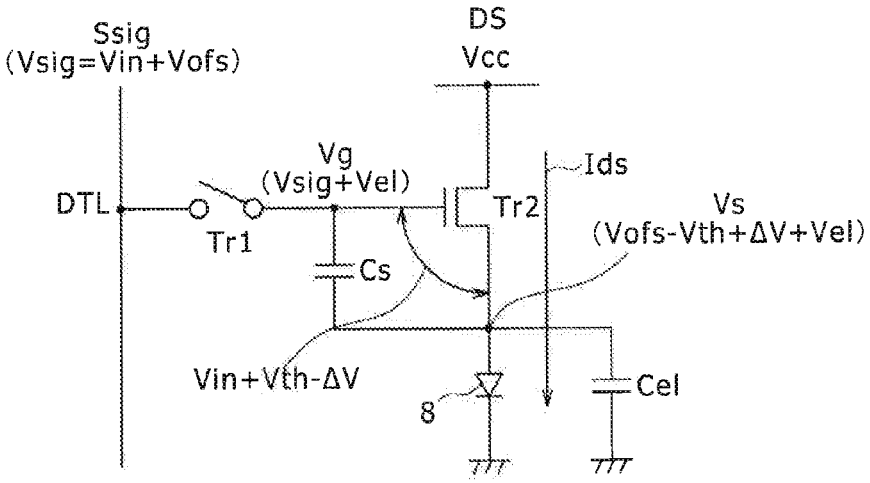
RELATED ART FIG.20
FIG. 20 is a connection diagram of assistance in explaining a continuation of FIG. 19.
Figures 21A, 21B, 21C, 21D, 21E, 21F:
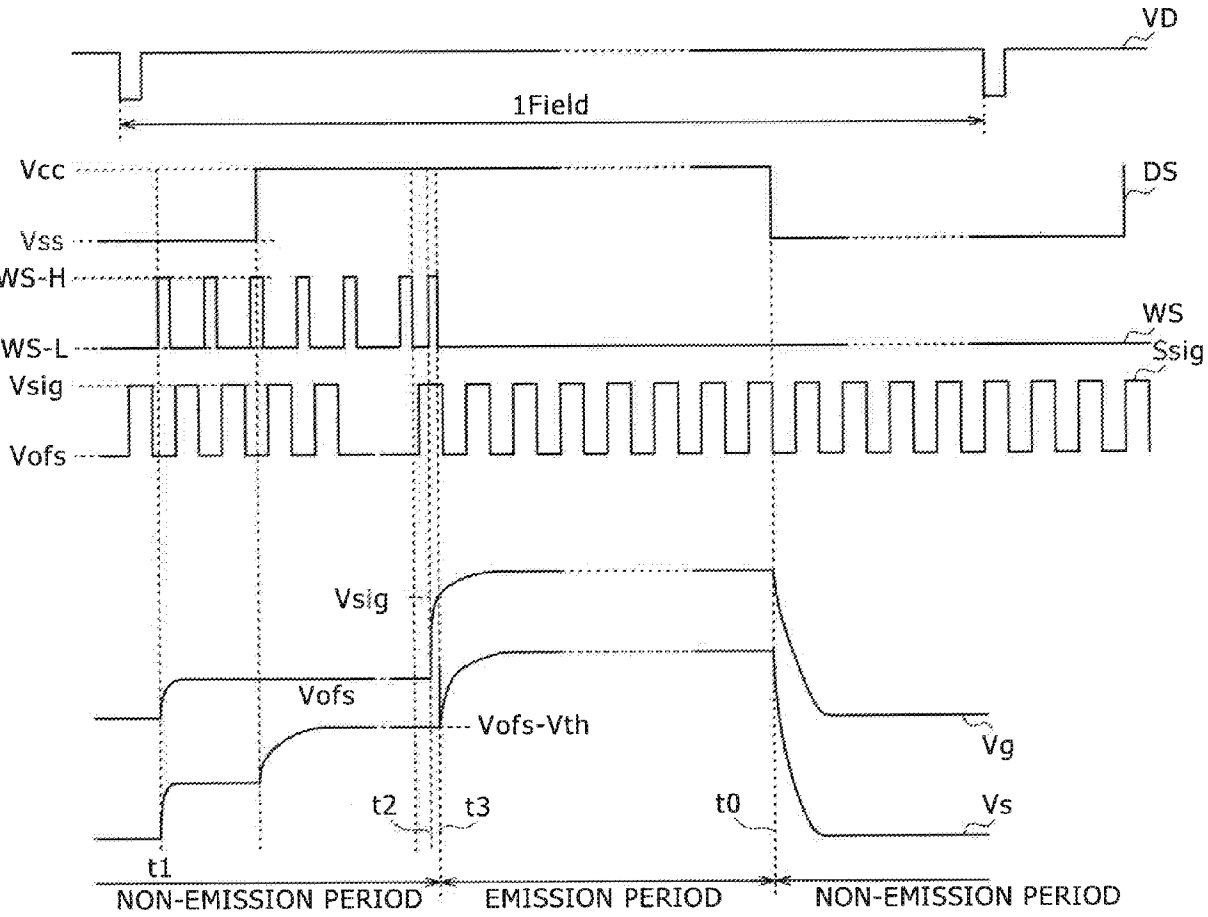
FIG.21F RELATED ART
FIGS. 21A, 21B, 21C, 21D, 21E, and 21F are time charts considered when a process of correcting a variation in threshold voltage is performed in a plurality of periods.

FIG. 1 is a connection diagram showing a pixel circuit applied to an image display device according to a first embodiment of the present invention by contrast with FIG. 11. FIG. 2 is a connection diagram showing the pixel circuit in a simplified manner. In the pixel circuit 25, a switch transistor Tr3 functioning as a switch circuit by performing on/off operation according to a cutoff signal CutOFF is provided between a driving transistor Tr2 and an organic EL element 8. In the image display device 21 according to the present embodiment, as shown in FIG. 3, the pixel circuit 25 is arranged in the form of a matrix to form a display section 22. The image display device 21 is formed in the same manner as the image display device 1 described above with reference to FIG. 11 except that the image display device 21 has a different constitution relating to control of the switch transistor Tr3.

Specifically, in this image display device 21 (FIG. 1), a signal line driving circuit 23 generates a gradation setting voltage Vsig for each pixel circuit 25 by a data scan circuit 23A, and sequentially outputs the gradation setting voltages Vsig to a signal line DTL with a fixed voltage Vofs for threshold voltage correction interposed between the gradation setting voltages Vsig. A scanning line driving circuit 24 outputs a writing signal WS, a driving signal DS, and a cutoff signal CutOFF from a write scan circuit 24A, a drive scan circuit 24B, and a cutoff scan circuit 24C, respectively.

Figures 4A, 4B, 4C, 4D, 4E, 4F, 4G, 4H:
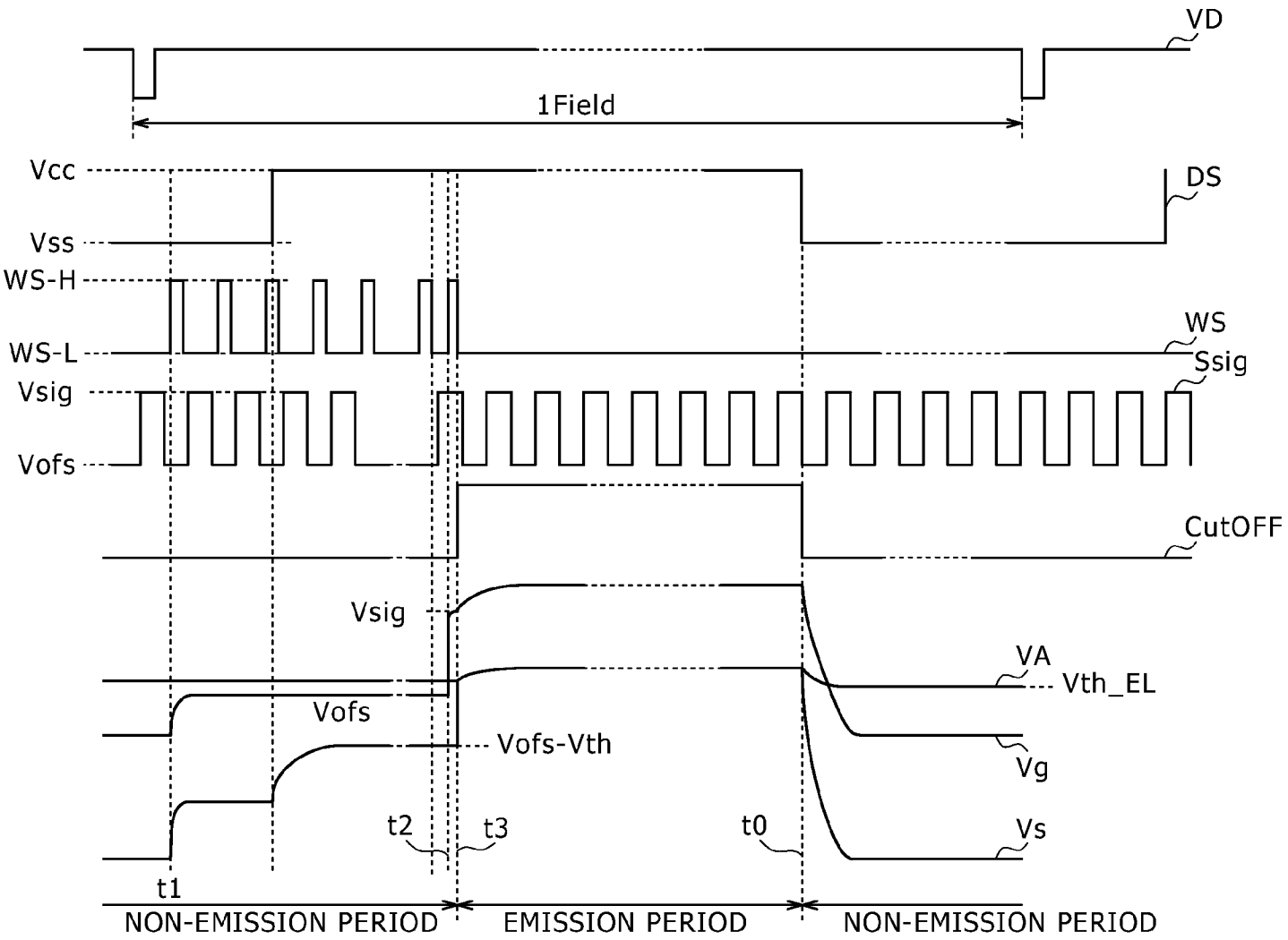
FIGS. 4A, 4B, 4C, 4D, 4E, 4F, 4G, and 4H are time charts of assistance in explaining operation of the pixel circuit of FIG. 1.

As shown in FIGS. 4A to 4H, in the image display device 21, the switch transistor Tr3 is set in an off state during a non-emission period by the cutoff signal CutOFF. Thereby a reverse bias applied to the organic EL element 8 is avoided effectively (FIG. 4E).

Figure 5:
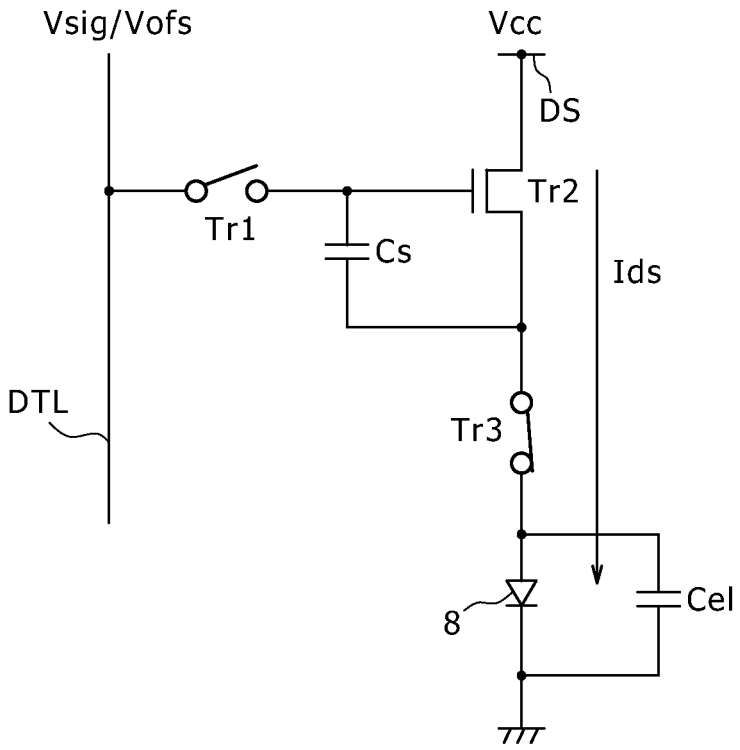
FIG. 5 is a connection diagram of assistance in explaining the time charts of FIGS. 4A to 4H.

Specifically, in the pixel circuit 25, during an emission period, as shown in FIG. 5, a writing transistor Tr1 and the switch transistor Tr3 are set in an off state and an on state, respectively, and a power supply voltage Vcc is supplied to the driving transistor Tr2 (FIGS. 4A to 4E). The pixel circuit 25 thereby drives the organic EL element 8 by a driving current Ids corresponding to a voltage across a storage capacitor Cs.

Figure 6:
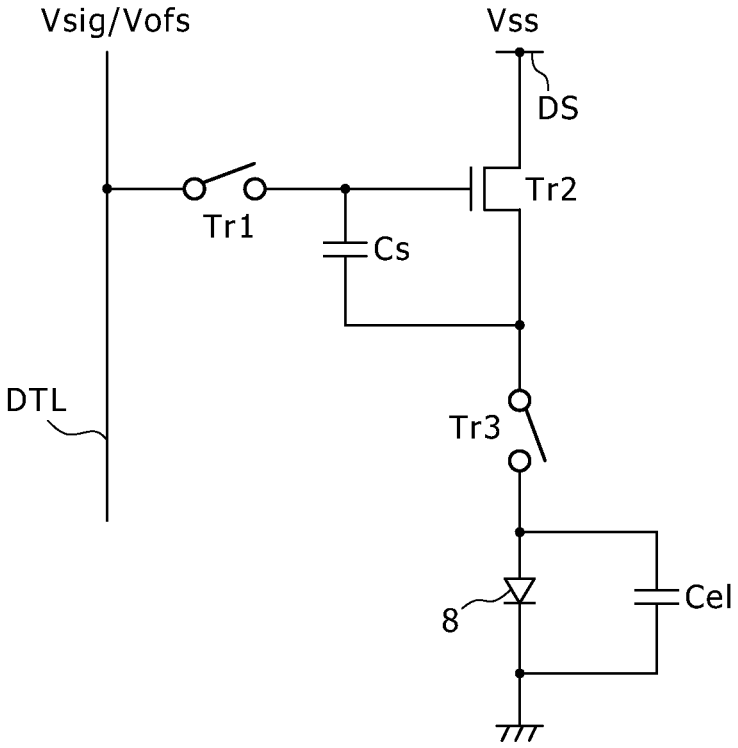
FIG. 6 is a connection diagram of assistance in explaining a continuation of FIG. 5.

In the pixel circuit 25, at time t0 at which the emission period ends, as shown in FIG. 6, the drain voltage of the driving transistor Tr2 is lowered to a fixed potential VSS, and the switch transistor Tr3 is set in an off state. Thereby, in the pixel circuit 25, an accumulated charge of a terminal on the organic EL element 8 side of the storage capacitor Cs flows out to a scanning line via the driving transistor Tr2, and thus the gate voltage Vg and the source voltage Vs of the driving transistor Tr2 are lowered (FIGS. 4G and 4H). At this time, because the switch transistor Tr3 is set in the off state, an accumulated charge of a stray capacitance Cel of the organic EL element 8 is discharged via the organic EL element 8, and the discharge lowers a voltage across the organic EL element 8 to the threshold voltage Vth EL of the organic EL element 8. As a result, the anode voltage VA of the organic EL element 8 is maintained at a voltage obtained by adding the threshold voltage Vth EL to a cathode voltage (FIG. 4F).

In the pixel circuit 25, the writing transistor Tr1 is set in an on state by the writing signal WS during a period during which the signal line DTL is next maintained at the fixed voltage Vofs for threshold voltage correction. Thereby, in the pixel circuit 25, the voltage across the storage capacitor Cs is set to a voltage more than the threshold voltage Vth of the driving transistor Tr2.

Figure 7:
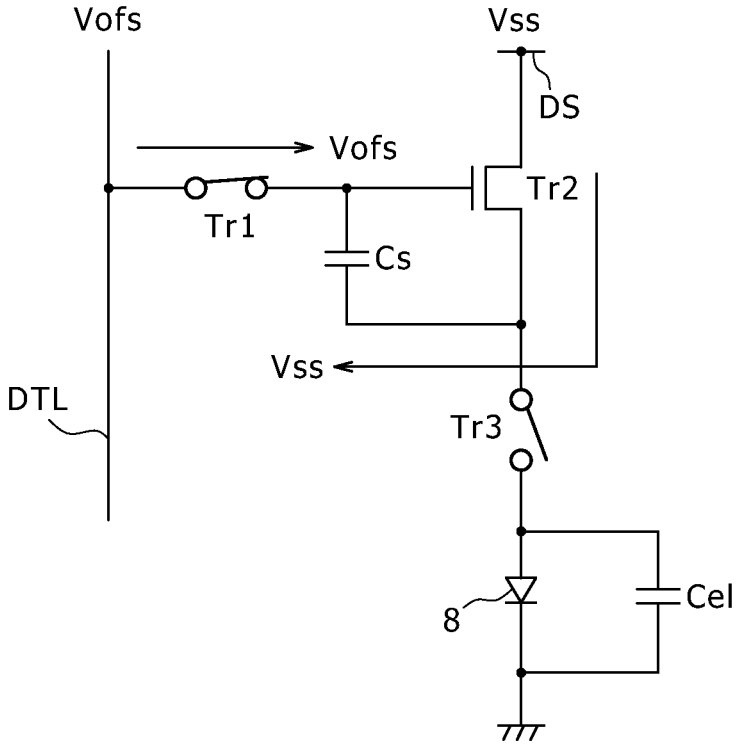
FIG. 7 is a connection diagram of assistance in explaining a continuation of FIG. 6.

In the pixel circuit 25, the drain voltage of the driving transistor Tr2 is raised to the power supply voltage Vcc, and the writing transistor Tr1 is set in an on state during periods during which the signal line DTL is maintained at the fixed voltage Vofs for threshold voltage correction. Thereby, as shown in FIG. 7, in the pixel circuit 25, the voltage across the storage capacitor Cs is set to the threshold voltage Vth of the driving transistor Tr2 over a plurality of divided periods.

In the pixel circuit 25, the writing transistor Tr1 is set in an on state at time t2 at which the signal line DTL is next maintained at the gradation setting voltage Vsig of the pixel circuit 25. Thereby a terminal voltage of the storage capacitor Cs is set to the gradation setting voltage Vsig. After the passage of a certain time, the writing transistor Tr1 is set in an off state. Thereby, variation in mobility is corrected, and the gradation setting voltage Vsig is sampled and held in the storage capacitor Cs.

Figure 8:
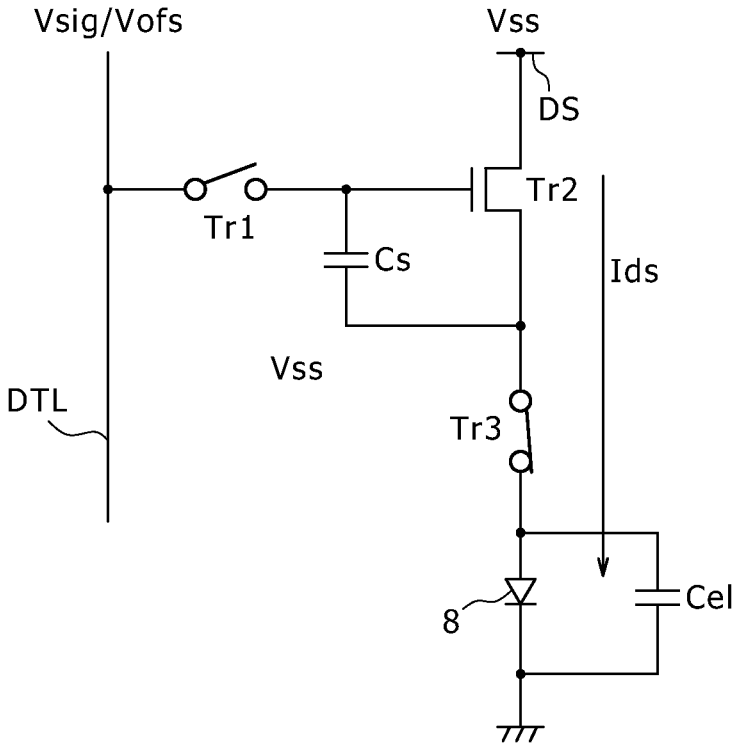
FIG. 8 is a connection diagram of assistance in explaining a continuation of FIG. 7.

As a result, as shown in FIG. 8, the pixel circuit 25 makes the organic EL element 8 emit light by a driving current Ids corresponding to the voltage across the storage capacitor Cs.

Figure 9:
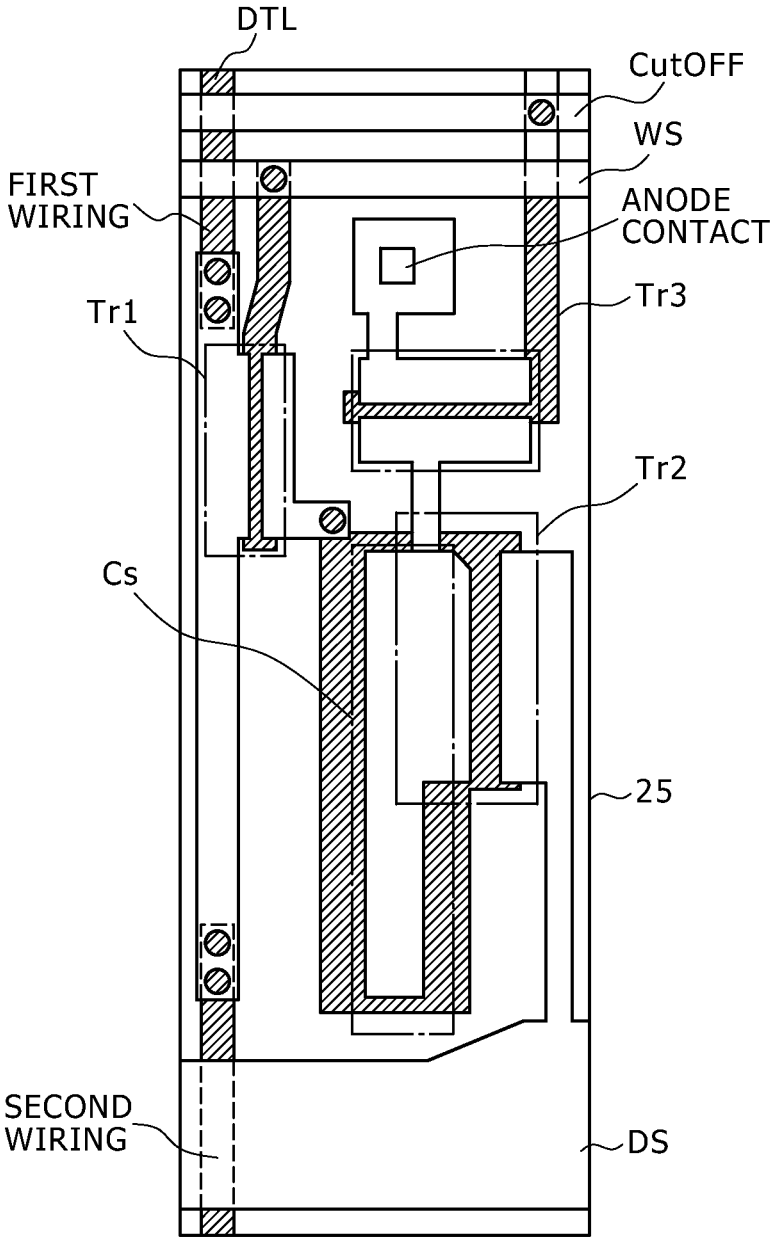
FIG. 9 is a plan view of a layout of the pixel circuit of FIG. 2.
Figure 10:
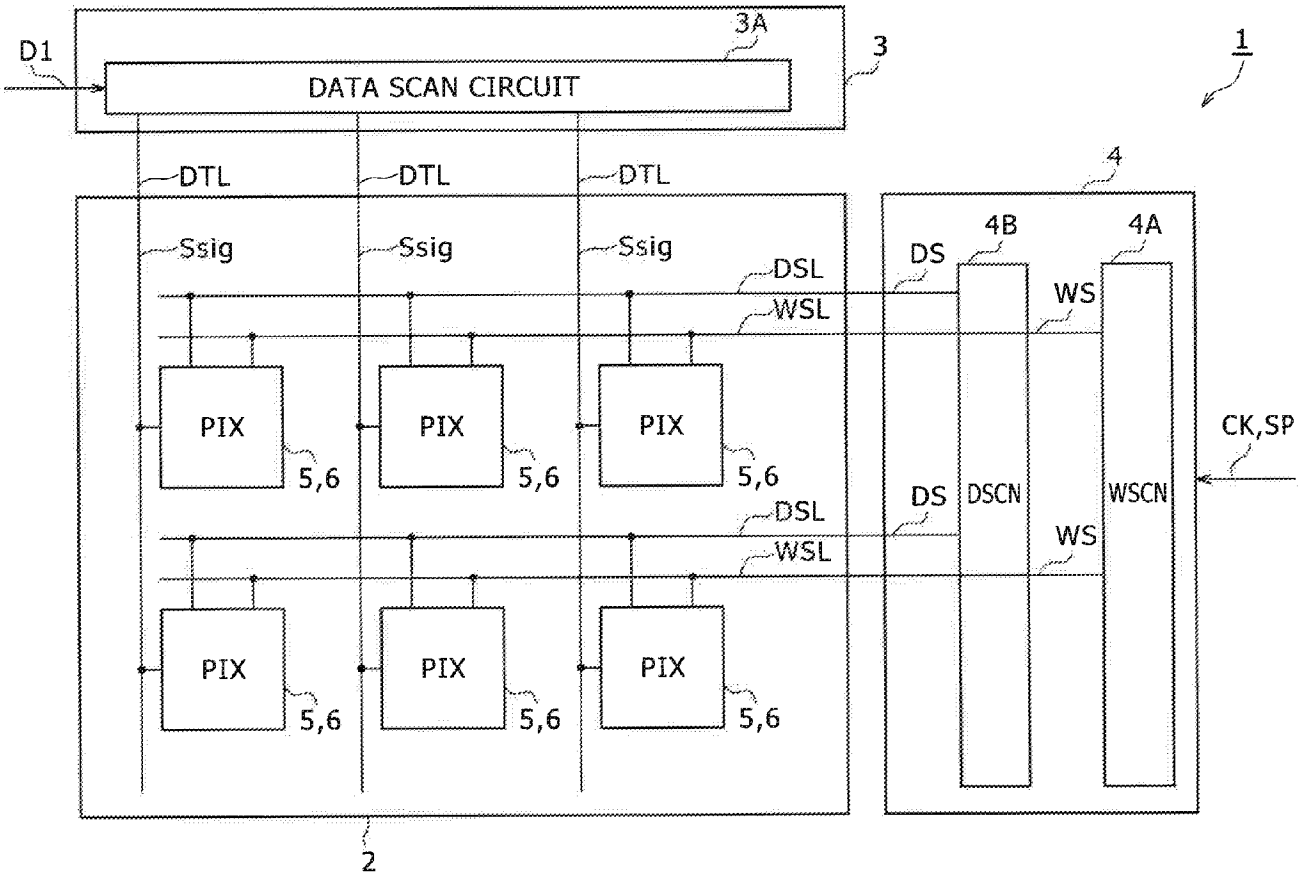
FIG. 10 is a block diagram showing an existing image display device.

FIG. 9 is a plan view of a layout of the pixel circuit 25. FIG. 9 is a plan view of a substrate side as viewed with members in upper layers from the anode electrode of the organic EL element 8 removed. In FIG. 9, a wiring pattern of each layer is shown by a difference in hatching. A circular mark represents a contact between layers. The inside of the circular mark is provided with a hatching assigned to a wiring pattern to which the contact is connected to indicate interlayer connection relation.

In the pixel circuit 25, after a wiring pattern material layer is deposited on an insulating substrate formed of glass, for example, the wiring pattern material layer is subjected to an etching process to create first wiring. In the pixel circuit 25, a gate oxide film is next created, and thereafter an intermediate wiring layer formed by a polysilicon film is created. In the pixel circuit 25, a channel protective layer and the like are next created, and thereafter transistors Tr1 to Tr3 are created by impurity doping.

In the pixel circuit 25, after a wiring pattern material layer is next deposited, the wiring pattern material layer is subjected to an etching process to create second wiring. In the pixel circuit 25, a scanning line DSL for power supply and a scanning line WSL for a writing signal are created by the second wiring. The scanning line DSL for power supply is created with a wider width than that of the scanning line WSL for a writing signal. In the pixel circuit 25, a signal line DTL is created by the second wiring as much as possible. Specifically, in the pixel circuit 25, only a part of the signal line DTL which part crosses the scanning lines DSL and WSL is created by the first wiring, and the other part of the signal line DTL is created by the second wiring. Consequently, the signal line DTL is provided with contacts for connecting the first wiring and the second wiring with the part crossing the scanning lines DSL and WSL interposed therebetween.

(2) Operation of Embodiment

With the above constitution of the image display device 21, in the signal line driving circuit 23, sequentially input image data D1 is distributed to signal lines DTL, and then subjected to a digital-to-analog conversion process. Thereby, in the image display device 21, a gradation voltage Vin indicating a gradation of each pixel connected to a signal line DTL is created for each signal line DTL. In the image display device 21, the gradation voltage Vin is set in each pixel circuit 25 forming a display section 22 on a line-sequential basis, for example, by the driving of the display section by the scanning line driving circuit 24. In each pixel circuit 25, the organic EL element 8 emits light at a light emission luminance corresponding to the gradation voltage Vin (FIG. 1). The image display device 21 can thereby display an image corresponding to the image data D1 on the display section 22.

More specifically, in the pixel circuit 5, the organic EL element 8 is current-driven by the driving transistor Tr2 of a source follower circuit configuration. In the pixel circuit 25, the voltage of the gate side terminal of the storage capacitor Cs provided between the gate and the source of the driving transistor Tr2 is set to a voltage Vsig corresponding to the gradation voltage Vin. The image display device 21 thereby makes the organic EL element 8 emit light at a light emission luminance corresponding to the image data D1 to display a desired image.

However, the driving transistor Tr2 applied to the pixel circuit 25 has a disadvantage of large variation in threshold voltage Vth. Consequently, in the image display device 21, when the voltage of the gate side terminal of the storage capacitor Cs is simply set to the voltage Vsig corresponding to the gradation voltage Vin, a variation in threshold voltage Vth of the driving transistor Tr2 causes a variation in light emission luminance of the organic EL element 8, thus degrading image quality.

Accordingly, in the image display device 21, after the voltage on the organic EL element 8 side of the storage capacitor Cs is lowered in advance, the gate voltage of the driving transistor Tr2 is set to a fixed voltage Vofs for threshold voltage correction via the writing transistor Tr1 (FIG. 2). Thereby, in the image display device 21, the voltage across the storage capacitor Cs is set larger than the threshold voltage Vth of the driving transistor Tr2. Thereafter the voltage across the storage capacitor Cs is discharged via the driving transistor Tr2. As a result of the series of processes, in the image display device 21, the voltage across the storage capacitor Cs is set to the threshold voltage Vth of the driving transistor Tr2 in advance.

Thereafter, in the image display device 21, a gradation setting voltage Vsig obtained by adding the fixed voltage Vofs to the gradation voltage Vin is set as the gate voltage of the driving transistor Tr2. The image display device 21 can thereby prevent degradation in image quality due to variations in the threshold voltage Vth of the driving transistor Tr2.

In addition, by maintaining the gate voltage of the driving transistor Tr2 at the gradation setting voltage Vsig in a state of power being supplied to the driving transistor Tr2 for a certain time, degradation in image quality due to variations in mobility of the driving transistor Tr2 can be prevented.

However, increase in resolution or the like may make it difficult to assign a sufficient time to the discharging of the voltage across the storage capacitor Cs via the driving transistor Tr2. In this case, the image display device cannot set the voltage across the storage capacitor Cs to the threshold voltage Vth of the driving transistor Tr2 with sufficiently high accuracy. As a result, a variation in threshold voltage Vth of the driving transistor Tr2 cannot be corrected sufficiently.

Accordingly, in the present embodiment, the voltage across the storage capacitor Cs is discharged via the driving transistor Tr2 in a plurality of periods. Thereby, a sufficient time is assigned to the discharge of the voltage across the storage capacitor Cs via the driving transistor Tr2, and thus a variation in mobility of the driving transistor Tr2 is corrected sufficiently even when resolution is increased.

However, when a variation in threshold voltage of the driving transistor Tr2 is thus corrected, the organic EL element 8 is reverse-biased, and there is a fear of destruction of the organic EL element 8.

Accordingly, in the present embodiment, the switch transistor Tr3 is provided between the organic EL element 8 and the driving transistor Tr2. The switch transistor Tr3 is set in an off state during non-emission periods. The image display device 21 can thereby perform the series of processes for correcting a variation in threshold voltage of the driving transistor Tr2 with the driving transistor Tr2 and the organic EL element 8 disconnected from each other. Thus, a variation in threshold voltage of the driving transistor can be corrected while the reverse biasing of the organic EL element 8 is effectively avoided.

(3) Effects of Embodiment

According to the above constitution, a switch transistor is disposed between a driving transistor and a light emitting element, and the switch transistor is set in an off state during non-emission periods. It is thereby possible to correct a variation in threshold voltage of the driving transistor while effectively avoiding destruction of the organic EL element due to a reverse bias.

Second Embodiment

It is to be noted that in the foregoing embodiment, description has been made of a case where the embodiment of the present invention is applied to an image display device in which a pixel circuit is formed with two transistors. However, the present invention is not limited to this, but is widely applicable to for example a constitution where the process of correcting a variation in threshold voltage is started after a voltage on the organic EL element side of a storage capacitor is lowered by a dedicated circuit configuration.

In addition, in the foregoing embodiment, description has been made of a case where the voltage across the storage capacitor is discharged via the driving transistor in a plurality of periods. However, the present invention is not limited to this, but is widely applicable to cases where the discharging process is performed in one period.

Further, in the foregoing embodiment, description has been made of a case where an n-channel type transistor is applied to the driving transistor. However, the embodiment of the present invention is not limited to this, but is widely applicable to image display devices and the like in which a p-channel type transistor is applied to the driving transistor.

Further, in the foregoing embodiment, description has been made of a case where the embodiment of present invention is applied to an image display device using an organic EL element. However, the present invention is not limited to this, but is widely applicable to image display devices using various self-luminous elements of a current-driven type.

The embodiment of the present invention relates to an image display device, and is applicable to an active matrix type image display device using an organic EL element, for example.

The present application contains subject matter related to that disclosed in Japanese Priority Patent Application JP 2008-144061, filed in the Japan Patent Office on Jun. 2, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image display device comprising:

a display section including a plurality of pixel circuits, at least one of the plurality of pixel circuits including:

a light emitting element connected between a first node and a common line;

a switch transistor connected between the first node and a second node;

a driving transistor connected between the second node and a third node;

a storage capacitor connected to a control terminal of the driving transistor via a control node; and a writing transistor connected between a signal line and the storage capacitor and configured to control a sampling operation, wherein an emission period during which the light emitting element is made to emit light and a non-emission period during which light emission of the light emitting element is stopped are alternately repeated;

in the emission period, at least one of the plurality of pixel circuits is driven such that:

a driving potential is applied to the third node so that driving current corresponding to voltage across the storage capacitor is supplied to the light emitting element via the driving transistor and the switch transistor;

in the non-emission period, at least one of the plurality of pixel circuits is driven such that:

a potential lower than the driving potential is applied to the third node and the driving transistor, and a terminal voltage of the storage capacitor is set to a potential corresponding to the signal line via the writing transistor, whereby the voltage across the storage capacitor is set to a voltage which is larger than a threshold voltage of the driving transistor, and subsequently the voltage across the storage capacitor is set to a voltage corresponding to the threshold voltage of the driving transistor;

wherein the switch transistor is set in an off state during the non-emission period, and wherein an anode voltage of the light emitting element is maintained at a voltage obtained by adding the threshold voltage of the driving transistor to a cathode voltage of the light emitting element during the non-emission period.

2. The image display device according to claim 1, wherein the terminal voltage of the storage capacitor is, at latest by a starting time of the emission period, set to a voltage related to light emission intensity.

3. The image display device according to claim 1, wherein the driving potential and the potential lower than the driving potential are time-divisionally supplied from a power supply line commonly connected to the plurality of pixel circuits.

4. The image display device according to claim 1, wherein during the non-emission period, an accumulated charge of the storage capacitor flows out to a scanning line via the driving transistor, and a voltage at the second node is lowered.

5. The image display device according to claim 4, wherein during the non-emission period, a voltage at the control terminal is lowered.

6. The image display device according to claim 1, wherein the storage capacitor is configured to set a gate-source voltage of the driving transistor.

7. The image display device according to claim 6, wherein during the non-emission period, at least one of the plurality of pixel circuits is driven such that the control terminal of the driving transistor is set to a potential corresponding to the potential lower than the driving potential, before the voltage across the storage capacitor is set to a voltage depending on the threshold voltage of the driving transistor.

8. An image display device comprising:

a display section including a plurality of pixel circuits, at least one of the plurality of pixel circuits including:

a light emitting element connected between a first node and a common line;

a switch transistor connected between the first node and a second node;

a driving transistor connected between the second node and a third node;

a storage capacitor connected to a control terminal of the driving transistor via a control node; and a writing transistor connected between a signal line and the storage capacitor and configured to control a sampling operation, wherein an emission period and a non-emission period of the light emitting element are alternately repeated, during the non-emission period, at least one of the plurality of pixel circuits is driven such that:

a potential lower than the driving potential is applied to the third node and the driving transistor, and a terminal voltage of the storage capacitor is set to a potential corresponding to the signal line via the writing transistor, whereby the voltage across the storage capacitor is set to a voltage which is larger than a threshold voltage of the driving transistor, and subsequently the voltage across the storage capacitor is set to a voltage depending on the threshold voltage of the driving transistor;

wherein the switch transistor is set in an off state during the non-emission period, and wherein an anode voltage of the light emitting element is maintained at a voltage obtained by adding the threshold voltage of the driving transistor to a cathode voltage of the light emitting element during the non-emission period.

* * * * *